US009765651B2

(12) United States Patent
Rop

(10) Patent No.: US 9,765,651 B2
(45) Date of Patent: Sep. 19, 2017

(54) HEAT EXCHANGE SYSTEM AND METHOD FOR STARTING-UP SUCH A HEAT EXCHANGE SYSTEM

(71) Applicant: NEM ENERGY B.V., Zoeterwoude (NL)

(72) Inventor: Peter Simon Rop, Benthuizen (NL)

(73) Assignee: NEM Energy B.V. (NL)

( * ) Notice: Subject to any disclaimer, the term of this patent is extended or adjusted under 35 U.S.C. 154(b) by 185 days.

(21) Appl. No.: 14/650,337

(22) PCT Filed: Nov. 29, 2013

(86) PCT No.: PCT/EP2013/075052
§ 371 (c)(1),
(2) Date: Jun. 8, 2015

(87) PCT Pub. No.: WO2014/090596
PCT Pub. Date: Jun. 19, 2014

(65) Prior Publication Data

US 2015/0316324 A1 Nov. 5, 2015

(30) Foreign Application Priority Data

Dec. 12, 2012 (EP) ..... 12196620

(51) Int. Cl.
*F28F 13/12* (2006.01)
*F01K 13/02* (2006.01)
(Continued)

(52) U.S. Cl.
CPC ..... *F01K 13/02* (2013.01); *F22B 1/08* (2013.01); *F22B 35/14* (2013.01); *F28B 1/02* (2013.01)

(58) Field of Classification Search
CPC .... F28B 1/02; F28B 1/08; F28B 35/14; F01K 13/02; F28D 7/00; F25B 1/00
(Continued)

(56) References Cited

U.S. PATENT DOCUMENTS 4,077,220 A * 3/1978 Matthews ..... F03G 7/04 417/366
4,120,158 A 10/1978 Sheinbaum
(Continued)

FOREIGN PATENT DOCUMENTS

GB 2436129 A 9/2007
JP S47006441 B 2/1972
(Continued)

OTHER PUBLICATIONS

International Search Report & Written Opinion PCT/EP2013/075052; International Filing Date: Nov. 29, 2013; 9 pgs.
(Continued)

*Primary Examiner* — Davis Hwu
(74) *Attorney, Agent, or Firm* — Schmeiser Olsen & Watts LLP

(57) ABSTRACT

A heat exchange system for producing superheated working fluid for a steam turbine from expected supercritical hydrothermal fluid from a geothermal reservoir, including a header-type heater with a shell is provided. An inlet is conducted to a feed pipe for transporting the expected supercritical hydrothermal fluid from the geothermal reservoir into the shell and where an outlet is conducted to a drain pipe for transporting the condensed hydrothermal fluid from the shell to a disposal, working fluid pipes circulating feed water from a condenser of the steam turbine into a heat exchange bundle system within the shell and retrieving superheated steam from the heat exchange bundle system for the steam turbine, a spraying device is arranged within the
(Continued)

Figure 1:
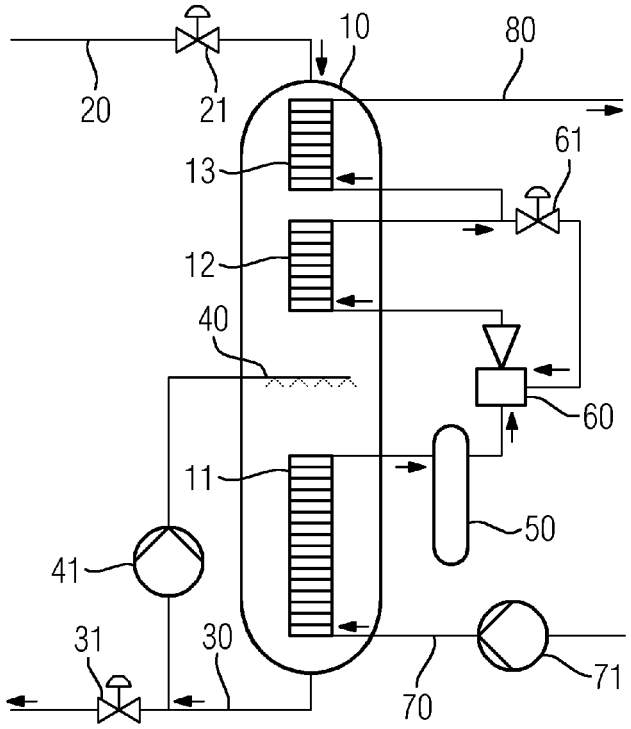

shell for spraying a first bundle of the heat exchange bundle system, and a mixing device is provided.

7 Claims, 1 Drawing Sheet

(51) Int. Cl.
*F22B 1/08* (2006.01)
*F22B 35/14* (2006.01)
*F28B 1/02* (2006.01)

(58) Field of Classification Search
USPC ..... 165/109.1
See application file for complete search history.

(56) References Cited

U.S. PATENT DOCUMENTS 4,142,108 A * 2/1979 Matthews ..... F03G 7/04 290/1 R
4,164,202 A 8/1979 Lockett, Jr.
4,232,992 A * 11/1980 Possell ..... F01D 1/36 415/164
4,566,532 A * 1/1986 Basmajian ..... F24J 3/085 165/108
2003/0033827 A1 2/2003 Lu
2010/0242533 A1 * 9/2010 De Larminat ..... F25B 39/028 62/498

FOREIGN PATENT DOCUMENTS

JP S5142844 A 4/1976
JP S63194110 A 8/1988
JP S63208677 A 8/1988
WO WO 2008042893 A2 4/2008

OTHER PUBLICATIONS

Extended European Search Report; Application No. 12196620.4-1610; 5 pgs.
International Preliminary Report on Patentability; PCT/EP2013/075052; International Filing Date: Nov. 29, 2013; 12 pgs.

* cited by examiner

HEAT EXCHANGE SYSTEM AND METHOD FOR STARTING-UP SUCH A HEAT EXCHANGE SYSTEM

CROSS-REFERENCE TO RELATED APPLICATIONS

This application claims priority to PCT Application No. PCT/EP2013/075052, having a filing date of Nov. 29, 2013, based on EP 12196620.4 having a filing date of Dec. 12, 2012, the entire contents of which are hereby incorporated by reference.

FIELD OF TECHNOLOGY

The following relates to a heat exchange system for producing superheated working fluid for a steam turbine from an expected supercritical hydrothermal fluid from a geothermal reservoir.

BACKGROUND

Supercritical hydrothermal fluids from geothermal deep drilling plants are expected as a potential alternative source for the production of electricity in the future. So e.g. the Iceland Deep Drilling Project (IDDP) is being carried out by an international industry and government consortium in Iceland, in order to investigate the economic feasibility of such an alternative. With drillings up to five kilometers into the earth crust, fluid temperatures in the range of 430-550° C. and a fluid pressure up to 250 bar can be achieved. First tests and analysis indicate that such a well, producing supercritical fluid, could have an order of magnitude higher power output than that from conventional high-temperature geothermal wells with a drilling depth of around two kilometers.

Due to the fact, that such fluids from deep drilling wells have a high silica concentration and acidity of around pH 3, the fluids are unsuited as working fluid for driving a steam turbine. A solution to overcome that problem is the usage of a heat exchanger. With such a heat exchanger, heat can be transferred from such a dirty fluid of a first circuit to a clean fluid of a second circuit. Therefore the heater typically comprising a shell, where an inlet is conducted to a feed pipe of the first circuit for transporting the expected supercritical hydrothermal fluid from the geothermal reservoir into the shell and where an outlet is conducted to a drain pipe for transporting the condensed hydrothermal fluid from the shell to a disposal. In working fluid pipes of the second circuit circulates clean feed water from a condenser of the steam turbine into a heat exchange bundle system within the shell and clean and superheated steam from the heat exchange bundle system back to the steam turbine. The steam turbine itself is connected with a generator for producing the electricity. One problem with acidic hydrothermal fluid from a deep drilling well is that the high silica concentration will lead to a scale formation and high acid concentration in the first condensate of the fluid in the shell of the heater, which forms locally at the outside surface of the heat exchange bundle system. This will reduce the performance of the heater and the overall heat exchange system, which leads to a reduced overall power output.

SUMMARY

An aspect relates to a heat exchange system and a method for start-up such a heat exchange system, which avoid the before mentioned problems.

The spraying device, which is arranged within the heater shell for spraying a first bundle of the heat exchange bundle system within the shell, increase the wetness of the expected supercritical hydrothermal fluid. Thus enough moisture is still available within the shell of the heater from the heat exchange system to keep the silica adhered in solution so that first condensate of the hydrothermal fluid is avoided. The mixing device, which is arranged between an output of the first bundle of a heat exchange bundle and an input of a working fluid down streamed second bundle, is controlled in such a way, that the temperature of the hydrothermal fluid at the input of the second bundle (seen from the working fluid) lies slightly above the saturation temperature. Thus a condensation of the hydrothermal fluid around the second tube bundle can be avoided.

The method for start-up such a heat exchange system according to embodiments of the invention, comprising the steps:

a) decrease the temperature of the expected supercritical hydrothermal fluid down to the saturation point of the hydrothermal fluid,
b) start the circulation of the working fluid at a low pressure level, such that an evaporation is initiated within the working fluid pipes,
c) start feeding the header-type heater with the expected supercritical hydrothermal fluid at a low pressure level and low flow to warm up all parts of the heat exchange system,
d) start the mixing and spraying devices for supporting the saturation process in the expected supercritical hydrothermal fluid,
e) increase the temperature of the expected supercritical hydrothermal fluid,
f) increase the pressure of the expected supercritical hydrothermal fluid,
g) increase the flow of the hydrothermal fluid and the working fluid for start-up the steam turbine.

Thus embodiments of the invention provide a heat exchange system and a respective start-up method, where a reduction of performance of the heater and the overall heat exchange system is avoided, and the overall power output can be kept on a high level.

In an embodiment, an ejector is used as the mixing device. Then the required warmer working fluid can be increased in pressure to be led back to the mixing point with a simple and compact device without any moving parts.

In a further embodiment of the present invention, the heat exchange bundle system comprising a third bundle, which is arranged working fluid down streamed from the second bundle, to optimize efficiency and controllability of the heat exchanger surfaces.

In a further embodiment, an attemperator is arranged in the feed pipe downstream of a supply valve. This has the effect, that the incoming hydrothermal fluid is reduced in temperature before it enters the shell of the heat exchanger.

In a preferred embodiment, the spraying device is feed from a spray pump, which is connected to the drain pipe. This has the advantage, that no external water source is required for the spraying device.

In a further preferred embodiment, a Benson-type bottle is arranged in the working fluid pipe between the first and second bundle of the heat exchange bundle system. This has the advantage, that the working fluid outlet temperature can be better controlled. It is also more efficient in assuring a shell-side temperature higher than saturation at the entrance of the second bundle.

BRIEF DESCRIPTION

Figure 2:
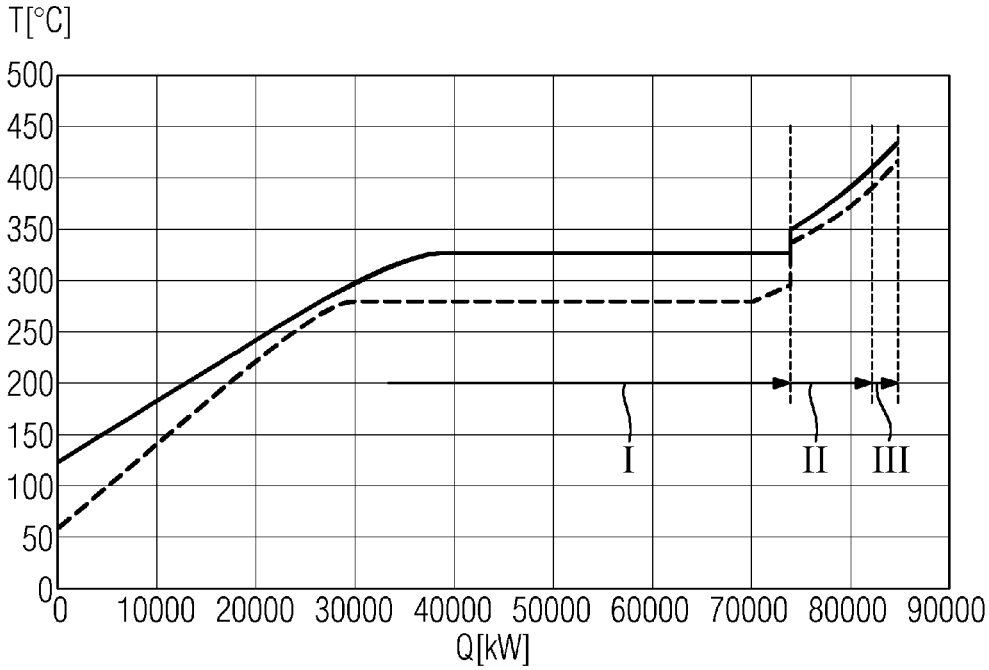

Some of the embodiments will be described in detail, with reference to the following figures, wherein like designations denote like members, wherein:

FIG. 1 shows a schematic view of a preferred embodiment of a heat exchange system; and FIG. 2 shows a Q-T diagram of the heater.

DETAILED DESCRIPTION

The main parts of a heat exchange system according to embodiments of the present invention are shown in FIG. 1. The shown embodiment comprises a vertical heat exchanger heater with a shell 10, where at the top of the shell, a feed pipe 20 is transporting expected supercritical hydrothermal fluid from a not further shown geothermal reservoir into the shell 10. Within the shell 10, the hydrothermal fluid flows from the top to the bottom while condensing, and the condensed hydrothermal fluid leaves the shell 10 and is transported through a drain pipe 30 to a not further shown disposal. Valves 21 and 31 in the feed pipe 20 and the drain pipe 30 can be foreseen for controlling the pressure and mass flow of the hydrothermal fluid in this first circuit, which is transporting this expected supercritical hydrothermal fluid from the deep drill reservoir to the disposal. In the present embodiment three heat exchange bundles 11, 12 and 13 are arranged in the shell 10 as a heat exchange bundle system. With these three heat exchange bundles, heat can be transferred from the expected hydrothermal fluid of the first circuit to a working fluid for a not further shown steam turbine. Therefore the three heat exchange bundles 11, 12 and 13 are arranged in series within the shell 10 and form along with pipes 70 and 80 a second circuit of the heat exchange system. Within that second circuit, feed water circulates from a not shown condenser of the steam turbine via a feed water pump 71 into the heat exchange bundle 11 of the heat exchange bundle system. In the heat exchange bundle system, the feed water is heated from the surrounded hydrothermal fluid, and converted to superheated steam. Then, that superheated steam circulates from the third heat exchange bundle 13 back to the steam turbine, expanded in the steam turbine and condensated in the condenser to feed water. According to embodiments of the invention, the heat exchange system further comprising a spraying device 40, which is arranged within the shell 10 for spraying the first 11 bundle of the heat exchange bundle system, and a mixing device 60, which is arranged between an output of the first bundle 11 and an input of a working fluid down streamed second bundle 12 for mixing working fluid from the output of the second bundle 12 with working fluid from the output of the first bundle 11. The spraying device 40 increases the wetness of the condensing steam and thus avoids first condensate. The mixing device 60 increases the temperature and thus avoids early condensation of hydrothermal fluid on the outside surface of the bundle. Both measures lead to avoidance of scale layer formation on the outside surface of the bundle. Also the extreme acidity that can occur in the first condensate, which is harmful for the bundle material, is avoided. Hence a reduction of performance of the heater and the overall heat exchange system can be avoided, and the overall power output can be kept on a higher level. An additional spraying pump 41, a Benson-type bottle 50 and a mixing device configured as an ejector with a valve 61 can be designed to further increase the performance of the heat exchange system.

FIG. 2 shows a Q-T diagram of the beforehand described heat exchange system, where the exchanged heat Q in kW is plotted versus the fluid temperature T in ° C. The continuous line shows how the hydrothermal fluid cools down in the heat exchanger, while the working fluid warms up (dashed line). The shown diagram is based on hydrothermal fluid conditions for a temperature of 435° C. and a pressure of 125 bar (a). A proposed embodiment for a start-up method of the heat exchange system comprises the subsequent steps:

- Decrease the temperature of the expected supercritical hydrothermal fluid down to the saturation point of the hydrothermal fluid. This can be done by a separate attemperator arranged downstream of the tunable (supply) valve 21 in the feed pipe 20. The attemperator is used to spray the temperature down to the saturation point.
- Start the circulation of the working fluid at a low pressure level, such that evaporation is initiated within the working fluid pipes 70 and 80 (see section I in the diagram) This can be done by controlling the feed water pump 71 and can be further supported by the Benson-type bottle 50.
- Start feeding the header-type heater with the expected supercritical hydrothermal fluid at a low pressure and a low flow level to warm up all parts of the heat exchange system. This can be done by the tunable (supply) valve 21. In parallel the steam turbine itself should be kept in bypass mode.
- Start the mixing devices 60 and spraying device 40 for supporting the saturation process in the expected supercritical hydrothermal fluid (also section I in the diagram). The spraying device avoids a scaling of the hydrothermal fluid in the neighborhood of the first heat exchange bundle 11, because enough moisture is available to keep the silica in solution. The recirc control valve 61 sends hot steam to the ejector 60 to mix the inlet steam temperature in the second heat exchange bundle 12 such, that the steam temperature leaves roughly 5° C. above the saturation of the hydrothermal fluid temperature in order to avoid condensation of this hydrothermal fluid outside the heat exchange bundle 12.
- Increase the temperature of the expected supercritical hydrothermal fluid until the attemperator is closed. So the saturation point will travel through section II and III, but at low pressure scaling is low.
- Increase the pressure of the expected supercritical hydrothermal fluid within the shell 10 until the full pressure is reached. With active mixing devices and spraying devices avoidance of condensation in section II and adequate wetness in section I can be reached during the transition between both sections.
- Increase the flow of the hydrothermal fluid and the working fluid for start-up the steam turbine. Therefore the flow of the hydrothermal fluid as well as the flow of the working fluid is increased. An extra attemperator in line 80 (not shown) might be required for steam temperature control during that steam turbine start-up phase. When the steam turbine has started, the (supply) valve 21 is put in load control and the feed water pump 71 is put in temperature control mode. The (supply) valve 21 can control the flow of the hydrothermal fluid, such that enough steam is generated for the steam turbine load.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A heat exchange system for producing superheated working fluid for a steam turbine from expected supercritical hydrothermal fluid from a geothermal reservoir, comprising:

a header-type heater with a shell, where an inlet is conducted to a feed pipe for transporting the expected supercritical hydrothermal fluid from the geothermal reservoir into the shell and where an outlet is conducted to a drain pipe for transporting the condensed hydrothermal fluid from the shell to a disposal, working fluid pipes circulating feed water from a condenser of the steam turbine into a heat exchange bundle system within the shell and retrieving superheated steam from the heat exchange bundle system for the steam turbine, wherein a spraying device is arranged within the shell for spraying a first bundle of the heat exchange bundle system, and a mixing device is arranged between an output of the first bundle and an input of a working fluid down streamed second bundle for mixing working fluid from the output of the second bundle with working fluid from the output of the first bundle.

2. The heat exchange system according to claim 1, wherein the mixing device is an ejector.

3. The heat exchange system according to claim 1, wherein the heat exchange bundle system comprising a third bundle arranged working fluid down streamed from the second bundle.

4. The heat exchange system according to claim 1, wherein an attemperator is arranged in the feed pipe downstream of a supply valve.

5. The heat exchange system according to claim 1, wherein the spraying device is fed from a spray pump, which is connected to the drain pipe.

6. The heat exchange system according to claim 1, wherein a Benson-type bottle is arranged in the working fluid pipe between the first and second bundle of the heat exchange bundle system.

7. A method for start-up a heat exchange system designed according to claim 1, comprising the steps:

a) decreasing the temperature of the expected supercritical hydrothermal fluid down to the saturation point of the hydrothermal fluid, b) starting the circulation of the working fluid at a low pressure level, such that an evaporation is initiated within the working fluid pipes, c) starting feeding the header-type heater with the expected supercritical hydrothermal fluid at a low pressure level and low flow to warm up all parts of the heat exchange system, d) starting the mixing and spraying devices for supporting the saturation process in the expected supercritical hydrothermal fluid, e) increasing the temperature of the expected supercritical hydrothermal fluid, f) increasing the pressure of the expected supercritical hydrothermal fluid, and g) increasing the flow of the hydrothermal fluid and the working fluid for start-up the steam turbine.

* * * * *